United States Patent [19]

Richards

[11] Patent Number: 4,558,813

[45] Date of Patent: Dec. 17, 1985

[54] CONTAINER AND SIDEWALL BLANK HAVING SINUSOIDAL EDGE PATTERN

[75] Inventor: Frank P. Richards, Prairie Village, Kans.

[73] Assignee: Sealright Co., Inc., Kansas City, Mo.

[21] Appl. No.: 394,100

[22] Filed: Jul. 1, 1982

[51] Int. Cl.[4] ..... B65D 3/14

[52] U.S. Cl. ..... 229/4.5; 229/5.5; 229/21; 229/DIG. 9

[58] Field of Search ..... 229/4.5, 5.6, 5.8, 21, 229/DIG. 9, 5.5; 220/66, 67

[56] References Cited

U.S. PATENT DOCUMENTS

| | | | |
|---|---|---|---|
| Re. 9,762 | 6/1881 | Jaeger | 229/DIG. 9 |
| 1,929,267 | 10/1933 | Weber | 229/4.5 |
| 2,149,625 | 3/1939 | Pabst | 229/21 X |
| 2,157,302 | 5/1939 | Page | 229/23 |
| 2,159,355 | 5/1939 | Goetze | 229/DIG. 9 |
| 2,606,106 | 8/1952 | Albertson | 229/4.5 |
| 2,755,983 | 7/1956 | Ringler | 229/DIG. 9 |
| 2,888,184 | 5/1959 | Hendry | 229/5.5 |
| 3,039,371 | 6/1962 | Leibreich | 93/55.1 |
| 3,120,917 | 2/1964 | Smith | 229/4.5 |
| 3,229,887 | 1/1966 | Fehres et al. | 229/5.5 |
| 3,369,726 | 2/1968 | Wilcox | 229/5.5 |
| 3,583,624 | 6/1971 | Peacock | 229/5.5 |
| 3,923,233 | 12/1975 | Smith | 229/5.5 |
| 3,930,607 | 1/1976 | Smith | 229/5.5 |
| 4,201,328 | 5/1980 | MacEwen | 229/4.5 |

FOREIGN PATENT DOCUMENTS

| | | | |
|---|---|---|---|
| 642192 | 9/1964 | Belgium | 229/DIG. 9 |

*Primary Examiner*—William Price
*Assistant Examiner*—Gary E. Elkins
*Attorney, Agent, or Firm*—Kokjer, Kircher, Bradley, Wharton, Bowman & Johnson

[57] ABSTRACT

A convolute sidewall container of paperboard or the like having an outwardly rolled top rim and a closed bottom, the container comprising a one-piece sidewall blank of generally rectangular shape having top and bottom edges, first and second side edges, and four corner edges. The bottom edge and preferably the top edge are defined by sinusoidal undulating edge portions which facilitate the formation of a uniformly crimped radially inwardly extending flange at the bottom edge and the outwardly rolled top rim at the top edge. A blanking die pattern for cutting the one-piece sidewall blanks and a method of forming such blanks is also disclosed.

5 Claims, 6 Drawing Figures

CONTAINER AND SIDEWALL BLANK HAVING SINUSOIDAL EDGE PATTERN

The invention relates generally to improved containers. In one aspect the invention relates to an improved container structure. In another aspect the invention relates to an improved sidewall configuration for the container structure. In still another aspect, the invention relates to method and apparatus for cutting the improved sidewalls from sheet material.

The use of convolute sidewall paperboard and thermoplastic-coated paperboard container is widely accepted for a large variety of packaging requirements. One particularly useful container configuration of this type employs an outwardly rolled top rim for accepting a closure having a generally planar surface with an annular skirt depending therefrom to engage the rolled container top rim. On such containers, the bottom is closed by a flat circular bottom member disposed within the lower portion of the convolute sidewall, and the lower surface of the bottom member is sealed by suitable means to the upper surface of a radially inwardly extending flange formed by inwardly crimping the bottom margin of the convolute sidewall. Such container structures and methods for their construction are disclosed in U.S. Pat. No. 3,369,726, issued to Wilcox, and in U.S. Pat. No. 3,583,624, issued to Peacock.

In achieving the above-mentioned bottom closure of such containers, it is desirable to form the radially inwardly crimped flange with maximum uniformity of the crimped sheet material to minimize wrinkling thereof and enhance the reliability and appearance of the seal between the flange and the bottom surface of the circular bottom member. It is also desirable to maximize the uniformity of the rolled top rims of such containers.

Accordingly, it is an object of the invention to provide a convolute sidewall container having an improved bottom closure structure.

Another object of the invention is to provide a convolute sidewall container having a uniformly crimped radially inwardly extending flange at the bottom of the convolute sidewall.

Another object of the invention is to provide an improved sidewall blank configuration which results in a uniformly crimped radially inwardly extending flange at the bottom of a convolute sidewall container.

Yet another object of the invention is to provide an improved sidewall blank configuration which can be efficiently cut from a web or sheet of sheet material with a minimum amount of waste.

Still another object of the invention is to provide an improved apparatus for cutting sidewall blanks from sheet material.

Another object of the invention is to provide an improved method of cutting sidewall blanks from sheet material.

In accordance with the invention there is provided a container sidewall blank comprising a piece of sheet material having a top edge, a bottom edge, a first side edge and a second side edge, with the bottom edge being at least partially defined by an undulating edge portion along at least a portion of the length of the bottom edge. There is also provided a tubular container comprising such a sidewall blank formed in a convolute shape to define a convolute sidewall for the tubular container. There is further provided both method and apparatus for cutting such sidewall blanks from sheet material.

Other objects and advantages of the invention will be apparent from the specification and claims to the invention when read in conjunction with the drawings in which:

Figure 1:
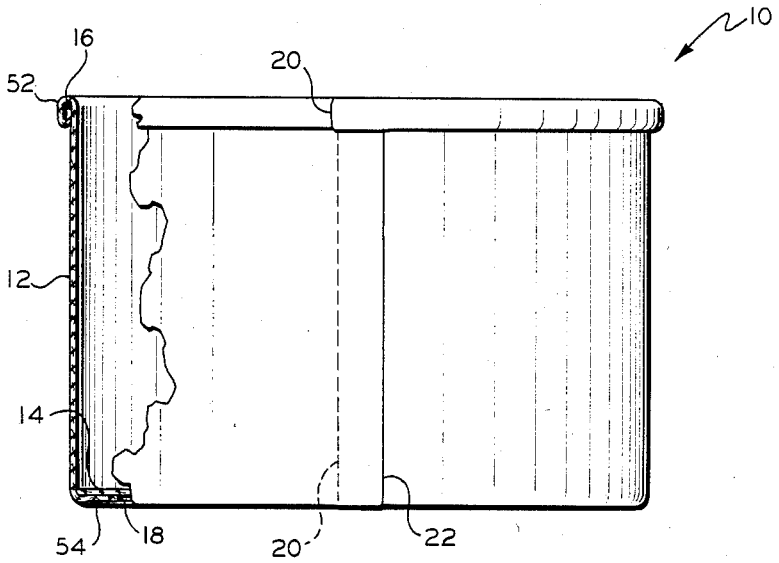
FIG. 1 is a side elevation view of a container constructed in accordance with the present invention in which a portion of the container is broken away to illustrate details of construction.
Figure 2:
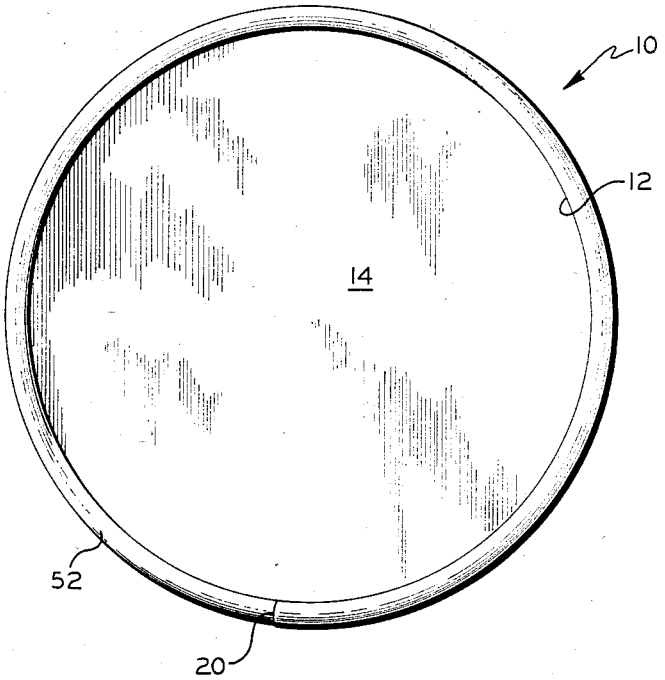
FIG. 2 is a top plan view of the container of FIG. 1.
Figure 3:
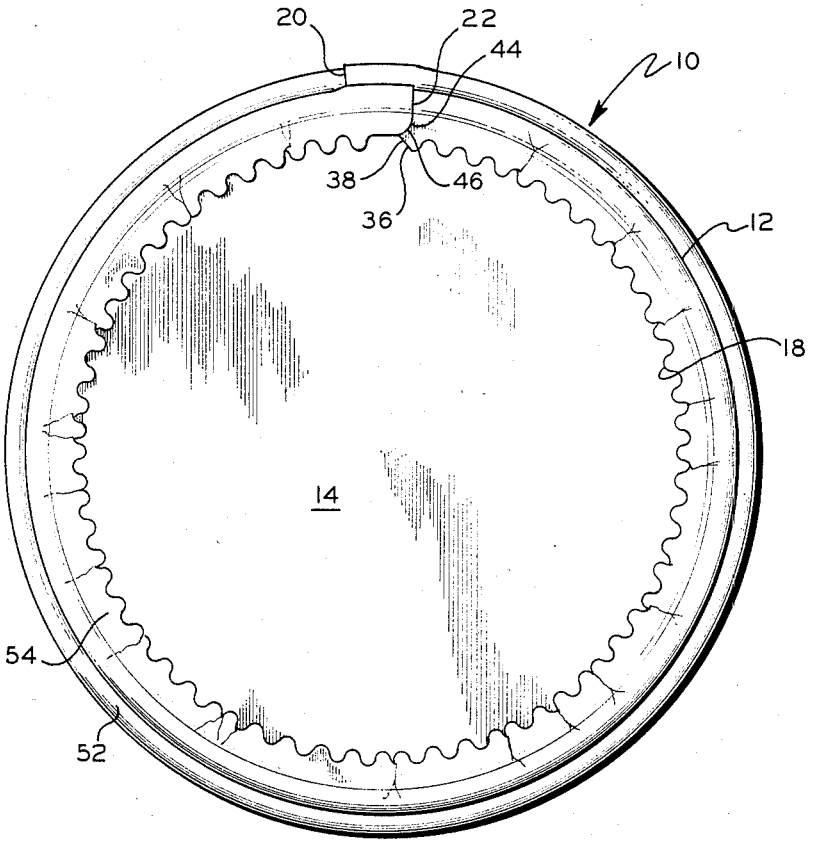
FIG. 3 is an enlarged bottom plan view of the container of FIG. 1.

Referring now to the drawings and to FIGS. 1, 2 and 3 in particular, there is illustrated therein a container constructed in accordance with the present invention and generally designated by the reference character 10. The container 10 comprises a one-piece sidewall 12 and a generally circular bottom member 14 having upper and lower surfaces. The sidewall 12 and the bottom member 14 are each formed of a suitable sheet material which can be readily formed into the configurations illustrated in the drawings. A suitable sheet material for this purpose is paperboard which is preferably provided with a film coating of a suitable thermoplastic on either or both sides thereof. In a preferred embodiment, the sheet material is in the form of a solid bleached kraft paperboard sold by International Paper Co. having a thickness of about 0.17 inch (0.432 mm) and coated on each side with a low density polyethylene film coating of about 0.00075 inch (0.019 mm).

Figure 4:
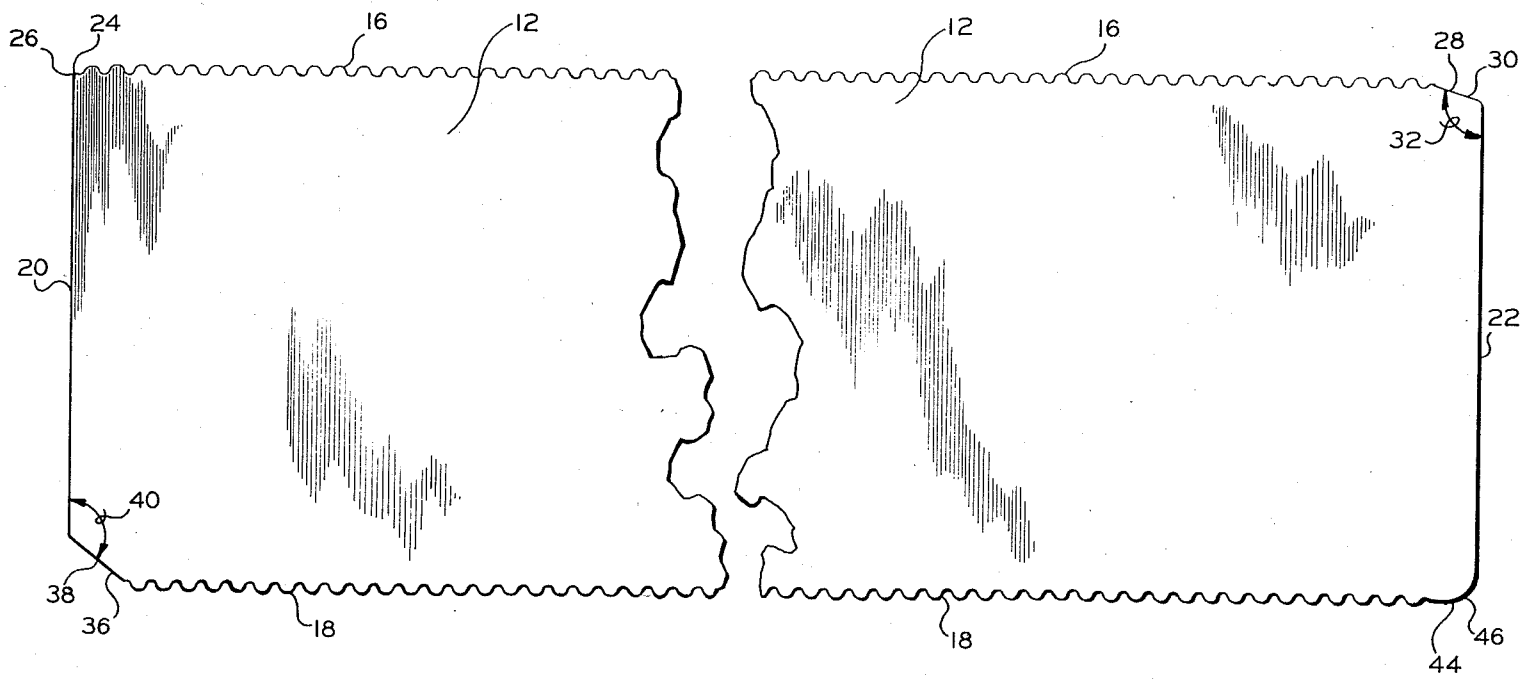
FIG. 4 is a plan view of a container sidewall blank constructed in accordance with the present invention.
Figure 5:
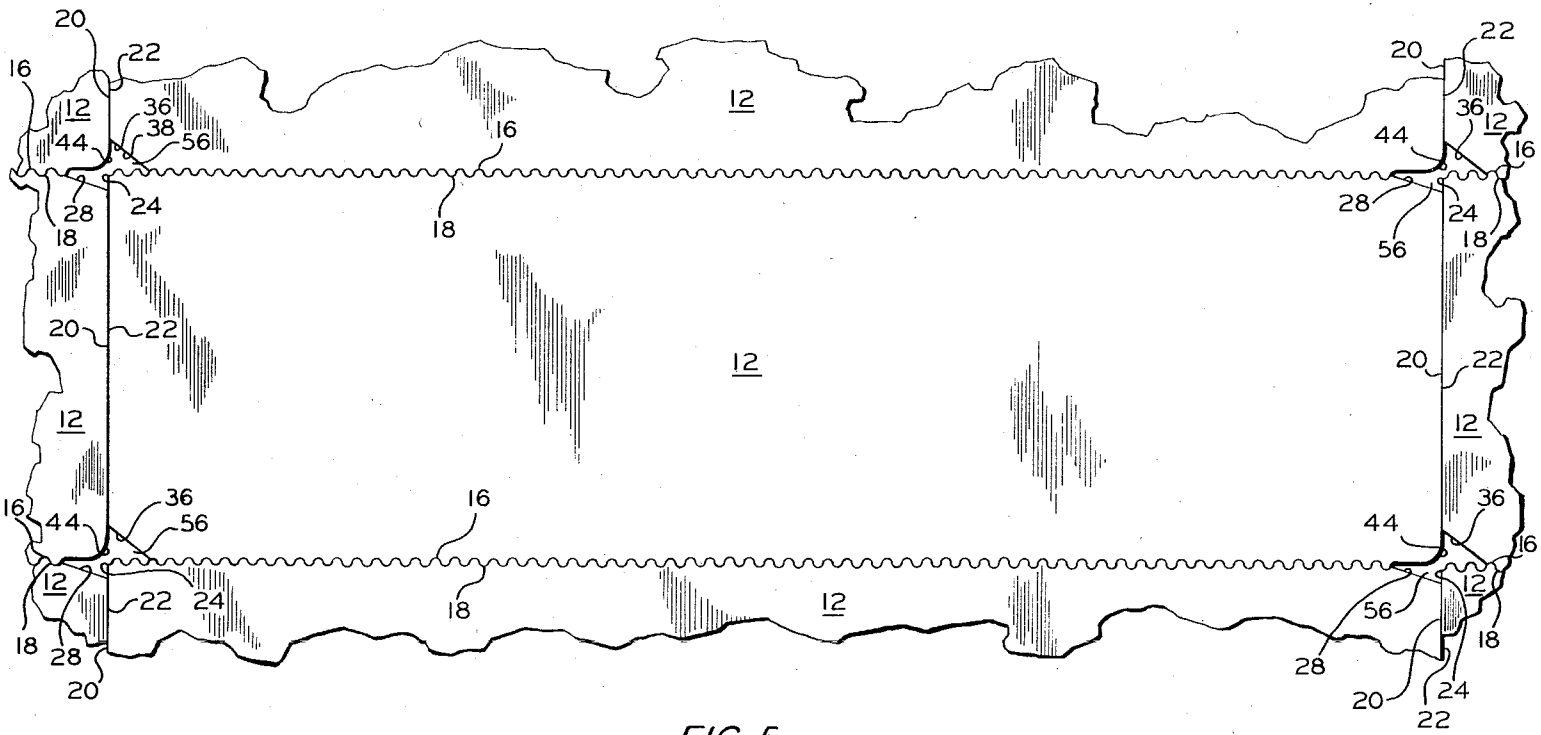
FIG. 5 is a plan view of a portion of a web of sheet material illustrating a sidewall blanking pattern in accordance with the present invention.
Figure 6:
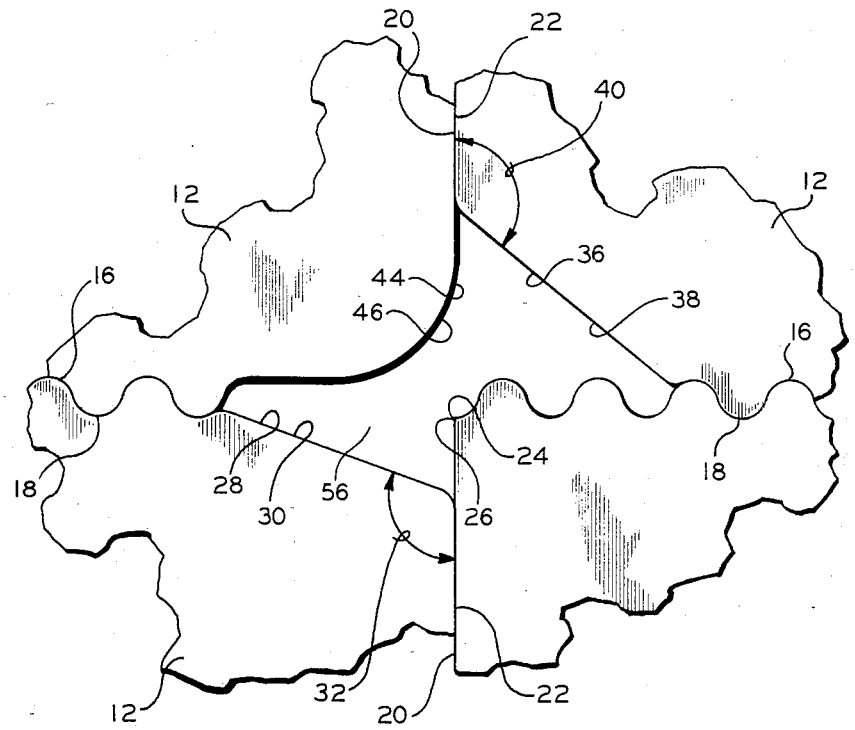
FIG. 6 is an enlarged portion of the web of FIG. 5 more clearly illustrating the cut-out portion between adjacent corner portions of adjacent sidewall blanks.

The sidewall 12 is constructed of a one-piece sidewall blank having a top edge 16, a bottom edge 18, a first side edge 20 and a second side edge 22, as best shown in FIGS. 4, 5 and 6. The top edge 16 and the bottom edge 18 are each defined by an undulating edge portion. In a presently preferred embodiment, these undulating edge portions are sinusoidal with a maximum vertical amplitude in a range from about 1/32 inch (0.8 mm) to about 3/32 inch (2.4 mm), more preferably about 1/16 inch (1.6 mm), and with a horizontal peak-to-peak distance between adjacent upper peaks in the range from about 3/32 inch (2.4 mm) to about 7/32 inch (5.6 mm), more preferably about 5/32 inch (4.0 mm).

A first corner edge 24 extends between the top edge 16 and the first side edge 20. The first corner edge 24 preferably comprises a first convex arcuate edge portion 26 tangentially intersecting the first side edge 20 and intersecting the undulating top edge 16. The first convex arcuate edge portion 26 preferably has a radius of curvature generally in the range from about 1/64 inch (0.4 mm) to about 3/64 inch (1.2 mm). It should be understood that the first corner edge 24 can also be in the form of a sharp corner, if desired, without departing from the spirit and scope of the present invention.

A second corner edge 28 extends between the top edge 16 and the second side edge 22. The second corner edge 28 preferably includes a generally straight edge portion 30. The edge portion 30 intersects the second side edge 22 at an included obtuse angle 32 in the range from about 94° to about 124°, and in a preferred embodiment at an angle of about 109°.

A third corner edge 36 extends between the bottom edge 18 and the first side edge 20. The third corner edge 36 preferably includes a generally straight edge portion 38. The edge portion 38 intersects the first side edge 20 at an included obtuse angle 40 in the range from about 115° to about 145°, and in a preferred embodiment at an angle of about 130°.

A fourth corner edge 44 extends between the bottom edge 18 and the second side edge 22. The fourth corner edge 44 includes a second convex arcuate edge portion 46 which tangentially intersects the second side edge 22 and has a radius of curvature preferably generally in the range from about 1/16 inch (1.6 mm) to about 5/16 inch (7.9 mm), and more preferably about 3/16 inch (4.8 mm).

The container 10 is characterized by an outwardly rolled top rim 52 formed on the sidewall 12 adjacent and along the top edge 16 and having a bead radius generally in the range from about 0.03 inch (0.76 mm) to about 0.1 inch (2.6 mm). Method and apparatus for forming such a top rim is disclosed in detail in U.S. Pat. No. 4,072,226, issued to Richards et al. In a preferred embodiment of the container 10, employing the previously mentioned paperboard, the top rim 52 has a nominal bead radius of about 0.05 inch (1.3 mm). The bottom edge 18 of the sidewall 12 is crimped inwardly below the bottom of the bottom member 14 forming a radially inwardly extending flange 54 which is sealingly engaged with the lower or bottom surface of the generally circular bottom member 14. As best shown in FIG. 1, the second side edge 22 overlaps the first side edge 20 a sufficient distance to achieve a suitable seal or seam between the overlapping surfaces adjacent the side edges and form a convolute tubular sidewall with the second side edge 22 on the outside and the first side edge 20 on the inside of the convolute tubular sidewall. In a preferred embodiment, the amount of overlap is generally in the range from about 0.25 inch (6.3 mm) to about 0.5 inch (12.7 mm), or more preferably about 5/16 inch (7.9 mm).

The seal between the flange 54 and the bottom member 14 and the seal between the overlapped first and second side edges 20 and 22 are preferably achieved by fusing the thermoplastic coatings of the adjacent paperboard surfaces through the application of heat and pressure to the seal areas by suitable means.

As best shown in FIG. 3, the undulating edge portion of the bottom edge 18 substantially defining the radially innermost edge of the flange 54 facilitates relatively uniform movement of the paperboard fibers of the sidewall 12 when the lower portion thereof is crimped radially inwardly below the bottom member 14 and sealed thereto by means of elevated temperature in a suitable mandrel and die mechanism such as that illustrated in U.S. Pat. No. 3,369,726, issued to Wilcox. This relatively uniform movement or circumferential compression of the paperboard fibers attributable to the employment of the undulating edge portion of the bottom edge 18 permits the radially inwardly extending flange 54 to be pressed tight and flat against the bottom member 14 to form a tight, substantially wrinkle-free seal between the upper surface of the flange 54 and the lower surface of the bottom member 14.

In a preferred embodiment of the second corner edge 28, the generally straight edge portion 30 intersects the second side edge 22 at a distance of about 5/32 inch (4.0 mm) measured vertically downwardly from a horizontal line along the upper peaks of the undulating edge portion of the top edge 16. In a preferred configuration of the third corner edge 36, the generally straight edge portion 38 intersects the first side edge 20 at a distance of about 11/32 inch (8.7 mm) measured vertically upwardly from a horizontal line along the lower peaks of the undulating edge portion of the bottom edge 18.

While the preferred thickness of the paperboard has been disclosed herein, it will be understood that any suitable thickness of relatively flexible sheet material suitable for use in the construction of the container 10 can be employed. A sheet thickness in the range from about 0.012 inch (0.30 mm) to about 0.022 inch (0.56 mm) can be generally utilized.

Referring now to FIGS. 5 and 6, there is illustrated therein a production blanking die pattern for cutting a plurality of blanks for the one-piece sidewall 12 from a sheet or web of sheet material. In the blanking die pattern so illustrated, it will be seen that the adjacent corner portions 24, 28, 36 and 44 of adjacent blanks define a cut-out portion of the sheet material, which portion is indicated by the reference character 56.

In a preferred embodiment, the blanking die pattern illustrated in FIGS. 5 and 6 is employed with a conventional punch-type or rolling-type blanking press or printer blanker. The desired die pattern design is transferred by suitable means to the blanking press die board, which is ordinarily formed of plywood, and grooves or slots are formed in the die board conforming to the pattern design. Steel ruling die knife blades, which conform to the desired die pattern design are then fixedly secured by suitable means in the corresponding grooves or slots to form a steel rule die assembly. This assembly is then mounted in a suitable blanking press of the punch type.

In operation of the punch-type blanking press, a continuous web of sheet material is fed into the blanking press between the die assembly and a flat platen made of aluminum or other suitable material where blanks are cut from the web by forcing the blades of the die assembly through the web against the platen. When the die assembly is withdrawn from contact with the web, the cut web is conveyed from the blanking press to a conventional stripper where edge scrap and the cut out portions between adjacent corners of the blanks are stripped from the web by means of picker fingers. It will be seen from FIGS. 5 and 6 that the identical undulating rule cut is advantageously applied to both the top edge 16 and bottom edge 18 of adjacent sidewall blanks which facilitates the nesting arrangement of paper board blanks so cut in the printing and cutting operations so as to minimize the amount of scrap generated. The same characteristics of the undulating edge portion of the bottom edge 18 which facilitates the crimping thereof and the sealing between the radially inwardly extending flange 54 and the bottom member 14 also facilitates the formation of the rolled top rim 52 formed on the sidewall 12 adjacent and along the top edge 16.

While the top and bottom edge configurations, as well as the corner configurations of the sidewall blank of the instant invention have been illustrated in conjunction with the fabrication of cylindrically shaped, tubular convolute sidewall containers, it will be understood that these corner configurations are equally applicable to the fabrication of frusto-conically shaped, nesting type, tubular convolute sidewall containers employing similar sealing between the sidewalls and bottom members thereof. The sidewall blanks used in the fabrication of cylindrically shaped tubular convolute sidewall containers are characterized by substantially parallel first and second side edges 20 and 22 and substantially parallel top and bottom edges 16 and 18, while sidewall blanks used in the fabrication of frusto-conically shaped nesting type tubular convolute sidewall containers are characterized by first and second side edges which diverge as they extend from the bottom edge toward the top edge, a top edge defining a generally convex arc, and a bottom edge defining a generally concave arc.

While each aspect of the invention has been described in conjunction with a preferred embodiment thereof, it is to be understood that equivalent embodiments and modifications by those skilled in the art are within the scope of the invention.

That which is claimed:

1. A container comprising:

a sidewall formed by a sheet having top and bottom edge portions and a pair of side edge portions, said sheet being formed in a convolute tubular shape with said side edge portions sealed together and said bottom edge portion terminating in a sinusoidal edge;

a bottom member having upper and lower surfaces and a substantially circular periphery;

a flange formed by crimping said bottom edge portion of the sheet generally radially inwardly beneath said bottom member with said flange located adjacent the lower surface of said bottom member and the entirety of said sinusoidal edge located radially inwardly of said circular periphery of the bottom member; and means for sealing said flange to said lower surface of said bottom member.

2. A container as set forth in claim 1, wherein said top edge portion of the sheet terminates in a sinusoidal edge.

3. A container as set forth in claim 1, wherein said sheet and bottom members are formed by thin pieces of paperboard.

4. A container as set forth in claim 3, wherein each piece of paperboard is coated with thermoplastic and said sealing means includes means for sealing said pieces of paperboard together by fusing together the thermoplastic coating said pieces.

5. A tubular container comprising:

a one-piece sidewall in the form of a single piece of sheet material having a top edge, a bottom edge, a first side edge, and a second side edge, said bottom edge being defined by a sinusoidal edge portion extending along the length of said bottom edge;

said single piece of said sheet material being formed in a convolute tubular shape with the second side edge overlapping said first side edge; thereby defining a convolute sidewall having a substantially circular container top and a substantially circular container bottom with said second side edge on the outside of said convolute sidewall and with the first side edge on the inside of said convolute sidewall;

means sealingly securing the adjacent overlapping surfaces of said single piece of sheet material adjacent said first and second side edges together;

a substantially circular bottom member having a generally circular periphery and upper and lower surfaces, said bottom member being disposed adjacent said substantially circular container bottom;

said substantially circular container bottom being characterized by a radially inwardly extending flange disposed adjacent the lower surface of said substantially circular bottom member, said sinusoidal edge portion forming the edge of said flange and being located radially inwardly of the circular periphery of said bottom member; and means sealingly securing the adjacent surfaces of said substantially circular bottom member and said radially inwardly extending flange.

* * * * *